US007039334B2

(12) United States Patent
Deguchi

(10) Patent No.: US 7,039,334 B2
(45) Date of Patent: May 2, 2006

(54) IMAGE FORMING DEVICE THAT CHANGES PROCESS SPEED ACCORDING TO ELECTRICAL PROPERTY OF TRANSFER MEMBER

(75) Inventor: Hideaki Deguchi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/687,817

(22) Filed: Oct. 20, 2003

(65) Prior Publication Data

US 2004/0086289 A1 May 6, 2004

(30) Foreign Application Priority Data

Oct. 24, 2002 (JP) ..... 2002-309837

(51) Int. Cl.
*G03G 15/16* (2006.01)

(52) U.S. Cl. ..... 399/66; 399/45; 399/81

(58) Field of Classification Search ..... 399/45, 399/66, 81

See application file for complete search history.

(56) References Cited

U.S. PATENT DOCUMENTS 5,075,731 A * 12/1991 Kamimura et al. ..... 399/66
5,159,393 A * 10/1992 Hiroshima et al.
5,690,324 A * 11/1997 Otomo et al.
6,026,269 A * 2/2000 Setoriyama ..... 399/66
6,374,062 B1 * 4/2002 Cheney ..... 399/45
6,402,405 B1 * 6/2002 Frodl et al.
6,452,607 B1 * 9/2002 Livingston
6,507,768 B1 * 1/2003 Regimbal et al.
2003/0185581 A1 * 10/2003 Hisada ..... 399/45

FOREIGN PATENT DOCUMENTS

JP A-6-161295 6/1994
JP 09-319170 A * 12/1997
JP A 9-325625 12/1997
JP A 9-325626 12/1997
JP A 10-301408 11/1998
JP A-2000-75687 3/2000
JP A 2000-258965 9/2000
JP A 2001-281944 10/2001

* cited by examiner

*Primary Examiner*—Susan Lee
(74) *Attorney, Agent, or Firm*—Oliff & Berridge, PLC.

(57) ABSTRACT

A voltage generated when a predetermined electric current is applied to a transfer roller is measured, and a sheet transport speed is determined based on the measured voltage, a sheet type, and a sheet width. The transport speed is reduced when current leakage tends to occur due to a narrow sheet width or low resistance in the transfer roller, so that the electric charge per unit area applied to the sheet is maintained constant without increasing a transfer bias to be applied to the transfer roller.

23 Claims, 6 Drawing Sheets

FIG.3

| | SHEET TYPE | THIN SHEET | | | | | NORMAL SHEET | |
|---|---|---|---|---|---|---|---|---|
| | SHEET WIDTH | 216mm ~ 191mm | 190mm ~ 161mm | 160mm ~ 131mm | 130mm ~ 101mm | 100mm ~ 70mm | 216mm ~ 191mm | |
| GENERATED VOLTAGE | ~ -7kV | STANDARD | STANDARD | STANDARD | STANDARD | STANDARD | STANDARD | |
| | -7 ~ -5 | STANDARD | STANDARD | STANDARD | 25ppm | 24ppm | STANDARD | |
| | -5 ~ -3 | STANDARD | 25ppm | 23ppm | 21ppm | 20ppm | 26ppm | |
| | -3 ~ -1 | 20ppm | 18ppm | 15ppm | 14ppm | 13ppm | 18ppm | |
| | -1kV ~ | 13ppm | 11ppm | 10ppm | 10ppm | 10ppm | 11ppm | |

FIG.5

| | SHEET TYPE | THIN SHEET | | | | | NORMAL SHEET | |
|---|---|---|---|---|---|---|---|---|
| | SHEET WIDTH | 216mm ~ 191 | 190 ~ 161 | 160 ~ 131 | 130 ~ 101 | 100 ~ 70 | 216mm ~ 191 | |
| GENERATED VOLTAGE | ~ -7kV | -10μA 28ppm | -11μA 28ppm | -12μA 28ppm | -13μA 28ppm | -14μA 28ppm | -11μA 28ppm | |
| | -7 ~ -5 | -12μA 28ppm | -14μA 28ppm | -14μA 28ppm | -14μA 25ppm | -14μA 24ppm | -13μA 28ppm | |
| | -5 ~ -3 | -14μA 28ppm | -14μA 25ppm | -14μA 23ppm | -14μA 21ppm | -14μA 20ppm | -14μA 26ppm | |
| | -3 ~ -1 | -14μA 20ppm | -14μA 18ppm | -14μA 15ppm | -14μA 14ppm | -14μA 20ppm | -14μA 18ppm | |
| | -1kV ~ | -14μA 13ppm | -14μA 11ppm | -14μA 10ppm | -14μA 10ppm | -14μA 10ppm | -14μA 11ppm | |

IMAGE FORMING DEVICE THAT CHANGES PROCESS SPEED ACCORDING TO ELECTRICAL PROPERTY OF TRANSFER MEMBER

BACKGROUND OF THE INVENTION

1. Field of the Invention

The present invention relates to an image forming device that forms images on a recording medium, and more specifically to an image forming device that forms images by transferring a developed image from an image carrying member onto a recording medium via a transfer member to which a transfer bias is applied.

2. Related Art

An image forming device well known in the art includes a transfer member for transferring a developer image carried on an image carrying member to a recording medium, a bias applying member for applying a transfer bias to the transfer member, and conveying members for conveying the recording medium through between the image carrying member and the transfer member in coordination with the operations of the image carrying member. Through the effects of the transfer bias applied to the transfer member, the developer image carried on the image carrying member is transferred onto the recording medium.

The magnitude of the transfer bias in this type of image forming device can conceivably be adjusted according to various conditions. For example, when maintaining the transfer bias at a constant current, the areas of the image carrying member that directly contact the transfer member increase as the width of the sheet decreases, increasing the potential for current leakage. Therefore, consideration has been given for increasing the absolute value of the transfer bias current as the sheet width decreases, as disclosed in Japanese unexamined patent application publication No. HEI-10-301408, for example.

However, if the absolute value of the transfer bias current is increased too much, then the transfer bias can exceed a withstand current of the image carrying member, such as a photosensitive drum, and the like, inviting damage to the same. As a result, there is a possibility that a poor transfer will occur due to insufficient electric current or the like because the magnitude of the transfer bias cannot be increased to exceed a prescribed value.

SUMMARY OF THE INVENTION

In the view of foregoing, it is an object of the present invention to overcome the above problems, and also to provide an image forming device capable of satisfactorily transferring a developer image onto a recording medium, even when the magnitude of the transfer bias cannot be increased sufficiently.

In order to attain the above and other objects, the present invention provides an image forming device including an image carrying member that carries a developer image, a transfer member that transfers the developer image from the image carrying member onto a recording medium, a bias applying member that applies a transfer bias to the transfer member, a transport member that transports the recording medium, an input member through which a width and a type of the recording medium are input, and a transport speed setting member that sets a transport speed at which the transport member transports the recording medium based on the width and the type of the recording medium inputted through the input member.

There is also provided an image forming device including an image carrying member that carries a developer image, a transfer member that transfers the developer image from the image carrying member onto a recording medium, the transfer member being a contact-type transfer member that transfers the developer image while transporting the recording medium through its own operation, a bias applying member that applies a transfer bias to the transfer member, an input member through which characteristics of the recording medium are input, a measuring member that measures electrical property of the transfer member before the transfer member performs the transfer, and a transport speed setting member that sets a transport speed at which the transfer member transports the recording medium based on the properties of the recording medium inputted through the input member and on the electrical property of the transfer member measured by the measuring member.

BRIEF DESCRIPTION OF THE DRAWINGS

In the drawings:

FIG. 2(*b*) is an explanatory diagram of relevant components of the laser printer of FIG. 1;

FIG. 3 is a process speed settings table according to the embodiment of the present invention;

FIG. 5 is a process speed setting stable according to a modification of the embodiment.

PREFERRED EMBODIMENTS OF THE PRESENT INVENTION

An image forming device according to a preferred embodiment of the present invention will be described while referring to the accompanying drawings.

Figure 1:
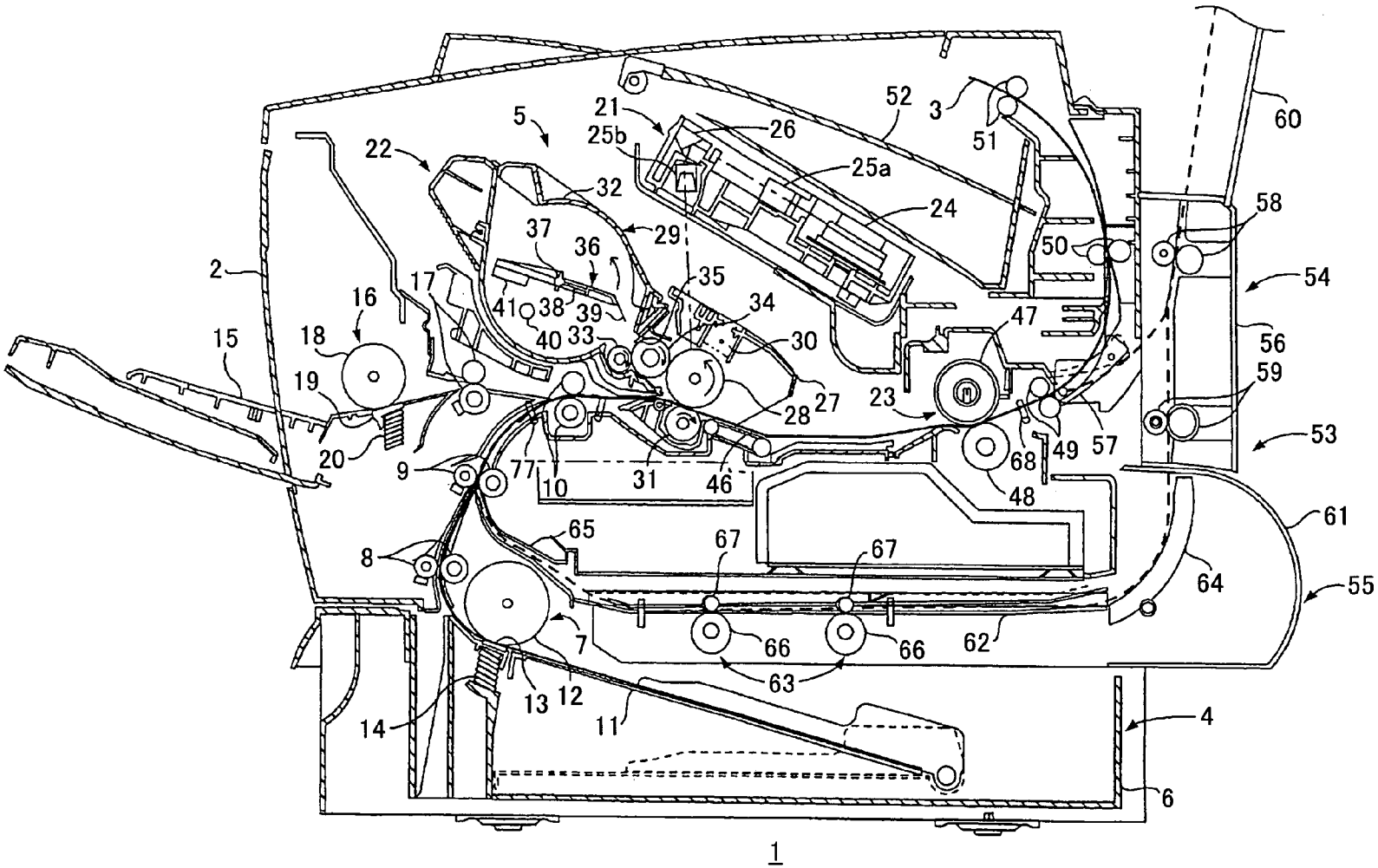
FIG. 1 is a cross-sectional side view of relevant construction of a laser printer according to an embodiment of the present invention.

A laser printer 1 according to the present embodiment has a configuration shown in FIG. 1.

The laser printer 1 is for forming images using an electrophotographic image forming technique by using a non-magnetic, single-component toner. A feeder section 4 and an image forming section 5 are provided within a casing 2 of the laser printer 1. The feeder section 4 is for supplying sheets 3. The image forming section 5 is for forming desired images on the supplied sheets 3.

The feeder section 4 is located within the lower section of the casing 2, and includes a sheet supply tray 6, a sheet feed mechanism 7, transport rollers 8 and 9, and registration rollers 10. The sheet supply tray 6 is detachably mounted to the casing 2. The sheet feed mechanism 7 is provided at one end of the sheet supply tray 6. The transport rollers 8 and 9 are provided downstream from the sheet feed mechanism 7 with respect to a sheet transport direction, in which sheets 3 are transported. The registration rollers 10 are provided downstream from the transport rollers 8 and 9 in the sheet transport direction.

The sheet supply tray 6 has a box shape with the upper side open so that a stack of sheets 3 can be housed therein. The sheet supply tray 6 can be moved horizontally into and out from the lower section of the casing 2 so as to be detachable from the casing 2. In the sheet supply tray 6, a sheet pressing plate 11 is provided. The sheet pressing plate 11 is capable of supporting a stack of sheets 3 thereon. The sheet pressing plate 11 is pivotably supported at its end furthest from the sheet feed mechanism 7 so that the end of the sheet pressing plate 11 that is nearest to the sheet feed mechanism 7 can move vertically. Although not shown in the drawing, a spring for urging the sheet pressing plate 11 upward is provided to the rear surface of the sheet pressing plate 11. Therefore, the sheet pressing plate 11 pivots downward in accordance with increase in the amount of stacked sheets 3 on the sheet pressing plate 11. At this time, the sheet pressing plate 11 pivots around the end of the sheet pressing plate 11 farthest from the sheet feed mechanism 7, downward against the urging force of the spring.

The sheet feed mechanism 7 is provided with a sheet supply roller 12, a separation pad 13, and a spring 14. The separation pad 13 is disposed in confrontation with the supply roller 12. The spring 14 is disposed to the rear side of the separation pad 13 and urges the separation pad 13 to press against the supply roller 12. With this configuration, the uppermost sheet 3 on the sheet pressing plate 11 is pressed toward the supply roller 12. Rotation of the supply roller 12 pinches the uppermost sheet 3 between the supply roller 12 and the separation pad 13. Then, cooperative operation between the supply roller 12 and the separation pad 13 separates one sheet 3 at a time from the stack and supplies the sheet 3 downstream in the sheet transport direction. The transport rollers 8 and 9 send the supplied sheets 3 to the registration rollers 10.

The registration rollers 10 are a pair of rollers that send a sheet 3 to an image forming position at a predetermined timing with respect to a timing when a registration sensor 77 detects the leading edge of the sheet 3. This operation is controlled by a CPU 71 (FIG. 2(*a*)) to be described later. It is noted that the image forming position is a transfer position, where visible toner images (developing agent images) are transferred from a photosensitive drum 28 (described later) onto the sheet 3. In other words, the image forming position is the contact position where the photosensitive drum 28 and a transfer roller 31 contact each other.

The feeder section 4 further includes a multipurpose tray 15, a multipurpose sheet supply mechanism 16, and multipurpose transport rollers 17. The multipurpose tray 15 can receive a stack of sheets 3 with any size. The multipurpose sheet supply mechanism 16 is for supplying sheets 3 on the multipurpose tray 15.

The multipurpose sheet supply mechanism 16 includes a multipurpose sheet supply roller 18, a multipurpose separation pad 19, and a spring 20. The multipurpose separation pad 19 is disposed in confrontation with the multipurpose sheet supply roller 18. The spring 20 is disposed to the underside of the multipurpose separation pad 19. The urging force of the spring 20 presses the multipurpose separation pad 19 against the multipurpose sheet supply roller 18.

With this configuration, rotation of the multipurpose sheet supply roller 18 pinches the uppermost sheet 3 of the stack on the multipurpose tray 15 between the multipurpose sheet supply roller 18 and the multipurpose separation pad 19. Then, cooperative operation between the multipurpose sheet supply roller 18 and the multipurpose separation pad 19 separates one sheet 3 at a time from the stack to supply. Then, the supplied sheet 3 is sent to the registration rollers 10 by the multipurpose transport roller 17.

The image forming section 5 includes a scanner section 21, a process unit 22, and a fixing section 23. The scanner section 21 is provided at the upper section of the casing 2 and is provided with a laser emitting section (not shown), a rotatingly driven polygon mirror 24, lenses 25*a* and 25*b*, and a reflection mirror 26. The laser emitting section emits a laser beam based on desired image data. As indicated by two-dot chain line, the laser beam passes through or is reflected by the polygon mirror 24, the lens 25*a*, the reflection mirror 26, and the lens 25*b* in this order so as to irradiate, in a high speed scanning operation, the surface of the photosensitive drum 28 of the process unit 22.

The process unit 22 is detachably mounted to the casing 2 at a position below the scanner section 21. The process unit 22 has a drum cartridge 27, within which the photosensitive drum 28, a scorotron charge unit 30, and the transfer roller 31 are mounted.

The developing cartridge 29 is detachably mounted to the drum cartridge 27. The developing cartridge 29 includes a toner hopper 32. The developing cartridge 29 further includes a supply roller 33, a developing roller 34, and a layer thickness regulating blade 35, which are disposed to the side of the toner hopper 32.

The toner hopper 32 is filled with positively charged, non-magnetic, single-component toner as a developing agent. For the toner, polymer toner obtained as a result of copolymerizing monomers by following a well-known polymerization technique such as suspension polymerization is used. Examples of polymerizable monomers are styrene monomers such as styrene, and acrylic monomers such as acrylic acid, alkyl (C1–C4) acrylate, alkyle (C1–C4) metaacrylate. Such polymerized toner has substantially sphere shape, and possesses extremely desirable fluidity. Furthermore, a colorant such as carbon black, and wax are combined in such toner. An external agent such as silica is externally attached to the polymerized toner to enhance the fluidity. The average diameter of the particle is approximately between 6 to 10 μm.

An agitator 36 is provided in the toner hopper 32. The agitator 36 includes a rotation shaft 37, an agitation blade 38, and a film 39. The rotation shaft 37 is rotatably supported at the center of the toner hopper 32. The agitation blade 38 is provided around the rotation shaft 37. The film 39 is adhered to the free end of the agitation blade 38. When the rotation shaft 37 rotates in a direction indicated by an arrow, the agitation blade 38 makes a circular movement so that the film 39 scrapes up toner in the toner hopper 32 to transport the toner toward the supply roller 33.

A cleaner 41 is provided to the rotation shaft 37 at an opposite side of the agitation blade 38. The cleaner 41 is for cleaning windows 40 disposed to the side walls of the toner hopper 32. The cleaning windows are used for detecting the remaining amount of toner.

The supply roller 33 is disposed to the side of the toner hopper 32 so as to be rotatable in a direction indicated by an arrow. The supply roller 33 includes a metal roller shaft covered with a roller formed from an electrically conductive urethane sponge material.

The developing roller 34 is disposed to the side of the supply roller 33 so as to be rotatable in a direction indicated by an arrow. The developing roller 34 includes a metal roller shaft covered with a roller formed from an electrically conductive resilient material. In more specific terms, the surface of the developing roller 34 is made from electrically conductive urethane rubber or silicone rubber including, for example, carbon particles. The surface of the roller portion is covered with a coat layer of silicone rubber or urethane rubber that contains fluorine. The developing roller 34 is applied with a predetermined developing bias with respect to the photosensitive drum 28.

The supply roller 33 is disposed in confrontation with the developing roller 34. The supply roller 33 is in contact with the developing, roller 34 to a certain extent that the supply roller 33 is compressed against the developing roller 34.

The layer thickness regulating blade 35 is disposed above the supply roller 33 so as to be in confrontation with the developing roller 34 following the axial direction of the developing roller 34, at a position downstream from a confronting position where the developing roller 34 contacts the supply roller 33 and upstream from a confronting position where the developing roller 34 contacts the photosensitive drum 28 with respect to the rotational direction of the developing roller 34. The layer thickness regulating blade 35 includes a leaf spring and a pressing member. The leaf spring is attached to the developing cartridge 29. The pressing member is mounted at the tip of the leaf spring and is formed of electrically-insulating silicone rubber to a semicircle shape when viewed in cross section. The pressing member is pressed onto the surface of the developing roller 34 by resilient force of the plate spring member.

Toner discharged from the toner hopper 32 is supplied to the developing roller 34 by rotation of the supply roller 33. At this time, the toner is charged to a positive charge by friction between the supply roller 33 and the developing roller 34. As the developing roller 34 rotates, the toner supplied on the developing roller 34 enters between the developing roller 34 and the pressing member of the layer thickness regulating blade 35, where the toner is fully charged again and borne on the developing roller 34 in a thin layer of uniform thickness.

The photosensitive drum 28 is disposed in confrontation with the side of the developing roller 34. The photosensitive drum 28 is supported in the drum cartridge 27 so as to be rotatable in a direction indicated by an arrow. The photosensitive drum 28 includes a main body connected to ground and a photosensitive surface layer made from polycarbonate to have a positively charging nature.

The scorotron charge unit 30 is supported in the drum cartridge 27 at a position above the photosensitive drum 28. The scorotron charge unit 30 is disposed in confrontation with the photosensitive drum 28 and separated from the photosensitive drum 28 by a predetermined space so as not to contact the same. The scorotron charge unit 30 is a positive-charge scorotron type charge unit for generating a corona discharge from a charge wire made from, for example, tungsten. The corona discharge uniformly charges the surface of the photosensitive drum 28 to a positive charge as the photosensitive drum 28 rotates.

After the scorotron charge unit 30 uniformly charges the surface of the photosensitive drum 28 to a positive charge, the surface of the photosensitive drum 28 is exposed by high speed scan of the laser beam from the scanner section 21. As a result, an electrostatic latent image is formed on the photosensitive drum 28 based on the image data.

When the positively-charged toner borne on the surface of the developing roller 34 is brought into contact with the photosensitive drum 28 by rotation of the developing roller 34, the toner on the developing roller 34 is supplied onto the electrostatic latent image on the photosensitive drum 28. That is, the toner is only supplied to the exposed area of positively charged surface of the photosensitive drum 28 whose electric potential has been decreased by the laser beam exposure. As a result, the toner is selectively borne on the photosensitive drum 28 so that the electrostatic latent image is developed into a visible toner image.

The transfer roller 31 is disposed below the photosensitive drum 28 in confrontation with the photosensitive drum 28. The transfer roller 31 is supported in the drum cartridge 27 so as to be rotatable in a direction indicated by an arrow. The transfer roller 31 is an ionic conductive type transfer roller that is made from a metal roller shaft covered by a roller made of ionic conductive rubber material. At times of toner image transfer, a transfer bias application power supply 81 to be described later (FIG. 2(*b*)) applies a transfer bias current to the transfer roller 31.

Rotation of the photosensitive drum 28 brings the visible toner image into contact with a sheet 3 that has been supplied by the registration rollers 10 after registration. As a result, the visible toner image borne on the surface of the photosensitive drum 28 is transferred onto the sheet 3 as the sheet 3 passes between the photosensitive drum 28 and the transfer roller 31. Then, the sheet 3 formed with the visible toner image is transported to the fixing section 23 by a transport belt 46.

The fixing section 23 is disposed to the side of and downstream from the process unit 22 in the sheet transport direction. The fixing section 23 includes a thermal roller 47, a pressing roller 48, and transport rollers 49. The thermal roller 47 is provided with a halogen lamp (heater) in a metal base pipe. The pressing roller 48 is disposed below the thermal roller 47 in confrontation with the thermal roller 47 so that the pressing roller 48 presses the thermal roller 47 from down below. The transport rollers 49 are disposed downstream from the thermal roller 47 and the pressing roller 48 with respect to the sheet transport direction.

The sheet 3 transported to the fixing section 23 is thermally fixed with visible images while passing between the thermal roller 47 and the pressing roller 48, and then transported to transport rollers 50 provided on the casing 2. The transport rollers 50 are disposed downstream from the transport rollers 49 in the sheet transport direction for transporting the sheet 3 to discharge rollers 51 positioned above a discharge tray 52 on the casing 2. The discharge rollers 51 discharge the sheet 3 onto the discharge tray 52.

The laser printer 1 uses the developing roller 34 to collect residual toner that remains on the surface of the photosensitive drum 28 after toner is transferred onto the sheet 3. In other words, the laser printer 1 uses a "cleanerless development method" to collect the residual toner. By using the cleanerless development method, there is no need to provide a separate member, such as a blade, for removing the residual toner or an accumulation tank for storing the collected waste toner, so that the configuration of the laser printer can be simplified.

The laser printer 1 further includes a retransport unit 53 that allows forming images on both sides of sheets 3. The retransport unit 53 includes an inverting mechanism 54 and a retransport tray 55 formed integrally with the inverting mechanism 54. The inverting mechanism 54 is attached externally to the rear side of the casing 2. The retransport tray 55 is freely detachably mounted by insertion into the casing 2 from a position above the feeder section 4.

The inverting mechanism 54 includes a casing 56, inversion rollers 58, retransport rollers 59, and an inversion guide plate 60. The casing 56 has a substantially rectangular shape when viewed in cross section. The inversion rollers 58 and the retransport rollers 59 are disposed in the casing 56. The inversion guide plate 60 protrudes upward from the upper portion of the casing 56.

A flapper 57 is pivotably supported at the rear side of the casing 2 and disposed downstream from the transport roller 49. The flapper 57 is for selectively switching transport direction of a sheet 3, which has been printed with images on its one side, between a direction toward transport rollers 50 as indicated by solid line and a direction toward the inversion rollers 58 as indicated by broken line. By activating or deactivating a solenoid (not shown), the flapper 57 selectively switches the transport direction.

The inversion rollers 58 are disposed downstream from the flapper 57 in the upper portion of the casing 56. The inversion rollers 58 are a pair of rollers that can switch rotational direction between forward and reverse directions. The inversion rollers 58 first rotate in the forward direction to transport a sheet 3 toward the inversion guide plate 60 and then rotate in the reverse direction to transport the sheet 3 in the reverse direction.

The retransport rollers 59 are disposed downstream from the inversion rollers 58 at a position substantially directly beneath the inversion rollers 58 in the casing 56. The retransport rollers 59 are a pair of rollers that transport the sheet 3 that has been inverted by the inversion rollers 58 to the retransport tray 55.

The inversion guide plate 60 is formed from a plate-shaped member that extends upward from the upper end of the casing 56 and serves to guide sheets 3 that are transported upward by the inversion rollers 58.

When a sheet 3 is to be formed with images on both surfaces, first the flapper 57 is switched into the position for guiding the sheet 3 toward the inversion rollers 58. In this condition, a sheet 3 formed with an image on one side is transported to the inversion rollers 58, and the inversion rollers 58 rotate forward with the sheet 3 sandwiched therebetween so that the sheet 3 is transported upward following the inversion guide plate 60. The inversion rollers 58 stop rotating when most of the sheet 3 is discharged from the casing 56 and the tailing end is sandwiched between the inversion rollers 58. Then, the inversion rollers 58 start rotating in the reverse direction to transport the sheet 3 downward to the retransport rollers 59. Here, a sheet passage sensor 68 is provided downstream from the fixing section 23. The timing at which rotation of the inversion rollers 58 is switched from forward to reverse is controlled to the time after a predetermined duration of time elapses from when the sheet passage sensor 68 detects the tailing edge of the sheet 3. It should be noted that when the sheet 3 reaches the inversion rollers 58, the flapper 57 switches to its initial position, that is, to the position for sending sheets 3 to the transport rollers 50.

The sheet 3 transported by the retransport rollers 59 in this manner is then transported by the retransport rollers 59 to the retransport tray 55.

The retransport tray 55 includes a sheet supply portion 61, a tray 62, and oblique rollers 63. The sheet supply portion 61 is attached to the rear end of the casing 2 at a position below the inverting mechanism 54. The sheet supply portion 61 includes an arc-shaped sheet guide member 64. In the sheet supply portion 61, the sheet guide member 64 guides sheets 3 that have been transported substantially vertically from the retransport rollers 59 into the substantially horizontal direction toward the tray 62.

The tray 62 is a substantially rectangular-shaped plate and provided in a substantially horizontal posture above the sheet supply tray 6. The upstream end of the tray 62 is connected to the sheet guide member 64. The downstream end of the tray 62 is connected to a midway section of the sheet transport pathway via the retransport pathway 65 so that the sheet 3 can be guided from the tray 62 to the transport rollers 9.

Two sets of oblique rollers 63 are disposed along the transport path of sheets 3 on the tray 62 and separated by a predetermined distance from each other in the sheet transport direction. The oblique rollers 63 are for transporting sheets 3 while abutting the sheets 3 against a reference plate (not shown) that is provided along one widthwise edge of the tray 62.

Each set of oblique rollers 63 includes an oblique drive roller 66 and an oblique follower roller 67. Each oblique roller 63 is disposed near the reference plate. Rotation axis of each oblique drive roller 66 extends in a direction substantially perpendicular to the sheet transport direction. Each oblique drive roller 66 is disposed in confrontation with the corresponding oblique follower roller 67 so that transported sheets 3 are sandwiched therebetween. Rotation axis of each oblique follower roller 67 extends at a slant from a direction perpendicular to the sheet transport direction so that the sheets 3 are transported toward the reference plate.

The oblique rollers 63 transport a sheet 3, which has been transported from the sheet supply portion 61 to the tray 62, while abutting the widthwise edge of the sheet 3 against the reference plate. Then, the sheet 3 is transported through the retransport pathway 65 once again to the image forming position with front and rear surfaces reversed. The rear surface of the sheet 3 is brought into contact with the photosensitive drum 28, and a visible toner image on the photosensitive drum 28 is transferred onto the rear surface of the sheet 3. The sheet 3 is fixed with the toner image by the fixing section 23 and then discharged onto the discharge tray 52 with images formed on both surfaces of the sheet 3.

In the present embodiment, the CPU 71 to be described later determines a process speed based on characteristics (size and thickness) of sheets 3 and on the resistance value of the transfer roller 31 and controls the transfer roller 31 in accordance with the determined process speed.

Figure 2A:
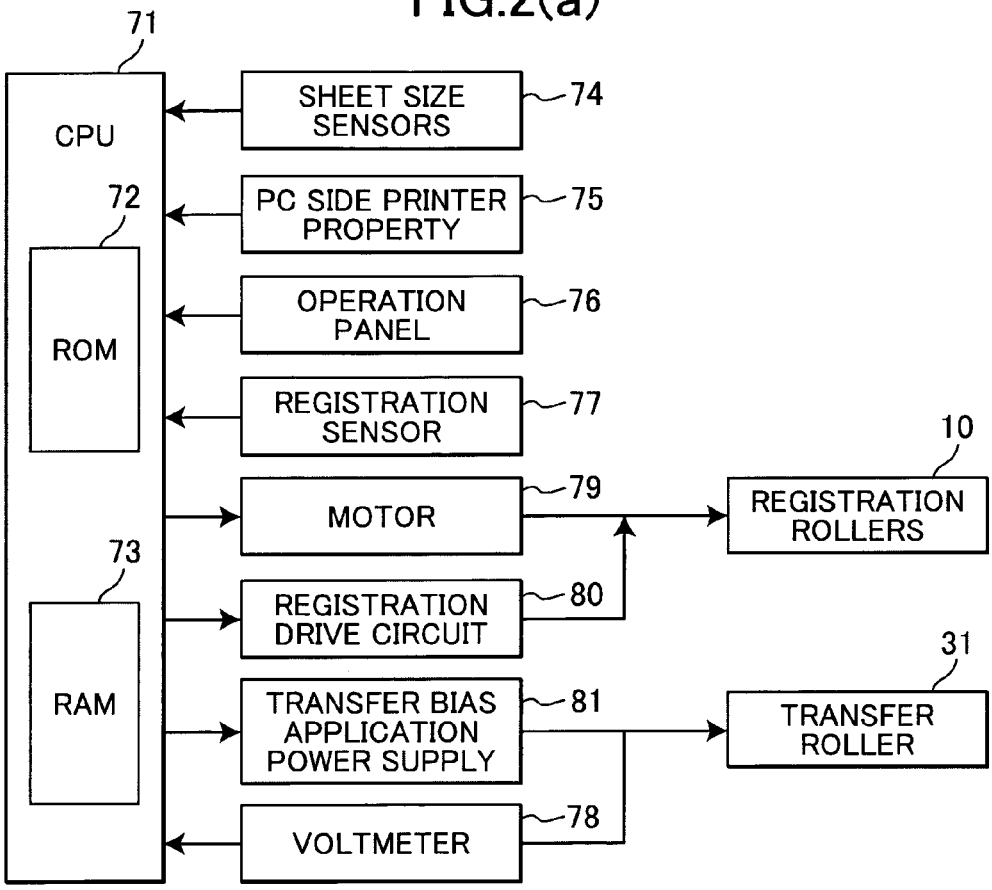
FIG. 2(*a*) is a block diagram of a control system of the laser printer of FIG. 1.
Figure 2B:
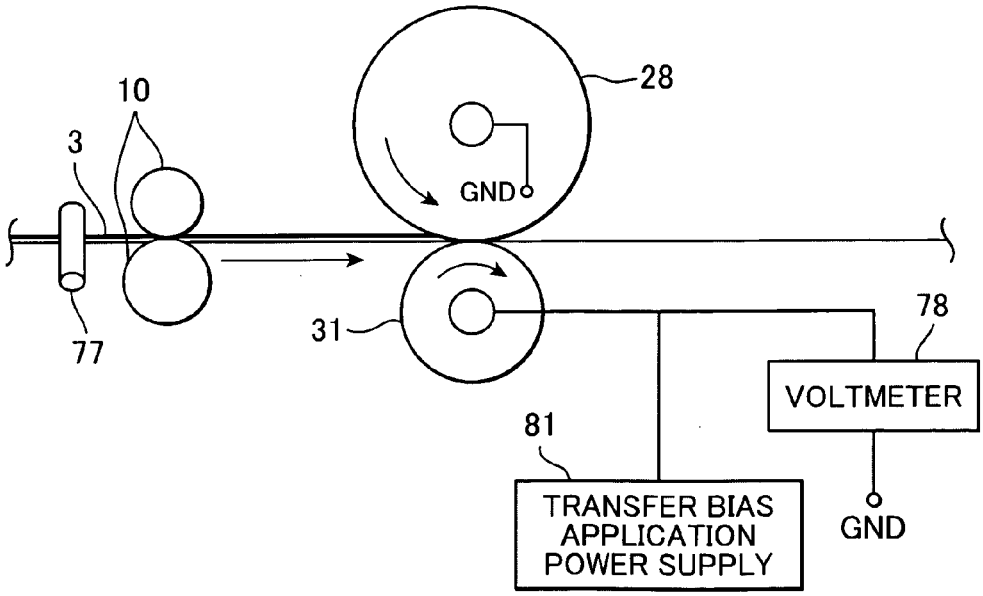

Next, a control system of the laser printer 1 will be described. As shown in FIG. 2(*a*), the control system of the laser printer 1 includes the CPU 71 and also sheet size sensors 74, a PC side printer property 75, an operation panel 76, a registration sensor 77, a motor 79, a registration drive circuit 80, a transfer bias application power supply 81, and a voltmeter 78, all connected to the CPU 71.

The CPU 71 is provided with a read only memory (ROM) 72 and a random access memory (RAM) 73, and controls each section in the laser printer 1. The ROM 72 stores control programs for controlling process speed and image forming operation and a sheet type detection program.

By executing the sheet type detection program, the CPU 71 detects the size and thickness of a sheet 3 based on the size and thickness of the sheet 3 detected by the sheet size sensors 74 or the size and thickness of the sheet 3 input through the PC side printer property 75 or the operation panel 76. It is noted that the size of the sheet 3 is defined as a width of the sheet 3 in a direction perpendicular to the sheet transport direction.

The RAM 73 temporality stores numerical values supplied from the sheet size sensors 74, the PC side printer property 75, the operation panel 76, the registration sensor 77, and the voltmeter 78. The numerical values are used for controllingly driving each section in the laser printer 1. The RAM 73 also stores numerical values measured by a timer and a counter to be described later.

Although not shown in FIG. 1, the sheet size sensor 74 is disposed inside each of the sheet supply tray 6 and the multipurpose tray 15 at a sheet-receiving area of the same. The sheet size sensor 74 detects the width (size) of sheets 3 set in the corresponding one of the sheet supply tray 6 and the multipurpose tray 15, and supplies data of the detected size to the CPU 71.

The PC side printer property 75 is an interface that enables an operator to set various settings for printing, such as the size and thickness of sheets 3, at the personal computer. Various settings set through the PC side printer property 75 are input to the CPU 71.

Although not shown in FIG. 1, the operation panel 76 is provided at the upper surface of the casing 2. The operation panel 76 includes several keys through which the operator can input various settings for printing. The settings input through the operation panel 76 are input to the CPU 71. It should be noted that it is possible to provide a plurality of sheet supply trays 6 and to input the size, thickness, type, or the like of sheets 3 accommodated in each sheet supply tray 6 from the personal computer or the operation panel 76 so as to indicate from which sheet supply tray 6 to supply sheets 3.

The laser printer 1 can perform printing operation on a plurality of different types of sheets 3. The CPU 71 classifies the plurality of types of sheets 3 into several (twenty, in this example) categories with respect to the thickness and the width (size) of the sheets 3. More specifically, sheets 3 are classified depending on the thickness of the sheets 3 into four categories: thin sheets, normal sheets, thick sheets, and very thick sheets. The sheets 3 are also classified depending on the width (size) of the sheets 3 into five categories: sheet width in a range of 216–191 mm, sheet width in a range of 190–161 mm, sheet width in a range of 160–131 mm, sheet width in a range of 130–101 mm, and sheet width in a range of 100–70 mm.

As shown in FIG. 1, the registration sensor 77 is disposed near and upstream from the registration rollers 10. The registration sensor 77 is turned ON when the leading edge of a sheet 3 reaches the registration sensor 77 and turned OFF when the trailing edge of the sheet 3 has passed by the registration sensor 77. This ON/OFF detection signal from the registration sensor 77 is input to the CPU 71. Based on the ON/OFF detection signal from the registration sensor 77, the CPU 71 detects the occurrence of paper jam and a current position of the leading edge of the sheet 3.

The motor 79 is for driving the respective components in the laser printer 1, including the registration rollers 10. Hence, the driving speed of each component, including the sheet supply roller 12, the transport rollers 8 and 9, the registration roller 10, the polygon mirror 24, the photosensitive drum 28, and the transfer roller 31, are controlled by changing the rotational speed (process speed) of the motor 79. The registration drive circuit 80 is for transmitting power of the motor 79 to the registration rollers 10, and for stopping transmitting the power to the registration rollers 10. The CPU 71 controls the registration drive circuit 80 to rotate the registration rollers 10 and to stop rotating the registration rollers 10.

As shown in FIG. 2(*b*), the transfer bias application power supply 81 is electrically connected to the roller shaft of the transfer roller 31. The CPU 71 controls the transfer bias application power supply 81 to apply the transfer roller 31 with a transfer bias current while maintaining the fixed amount of the transfer bias current by executing a constant current control.

The voltmeter 78 is electrically connected to a circuit which is connected between the transfer bias application power supply 81 and the transfer roller 31. The voltmeter 78 measures the voltage of the transfer roller 31 over a range of several millimeters in the printing area of the transfer roller 31. Specifically, the voltmeter 78 detects a voltage value which is generated by the transfer roller 31 in response to application of a predetermined transfer current as a measurement current and inputs the detected voltage value to the CPU 71. Thus determined voltage value is indicative of the value of the resistance of the transfer roller 31. The CPU 71 uses this voltage value data as a parameter for determining the process speed.

The transfer roller 31 is an ion-conductive type. This type of transfer roller 31 effectively transports the sheet 3 while transferring a visible image (toner image) carried on the photosensitive drum 28 to the sheet 3. Moreover, the ion-conductive type transfer roller is formed by adding ionic material to a resilient member and can achieve effective transferring since the roller has a uniform resistance with few irregularities. Although the resistance of this ion-conductive type transfer roller changes easily in a humid environment, a transfer bias or process speed suitable to these changes in resistance can be selected by performing the control process described below to achieve satisfactory transfers.

The ROM 72 stores a process speed settings table in which process speeds of the motor 79, measured by pages per minute (ppm), are set in association with the generated voltage in the transfer roller 31 as measured by the voltmeter 78, the sheet type, and the sheet width. As shown in FIG. 3, the process speed settings table is divided into the aforementioned five categories of sheet width for each sheet type, which in the present embodiment is the thickness of the sheet 3 and includes thin sheet, normal sheet, thick sheet, and very thick sheet. Each element in the table is set to a process speed corresponding to the generated voltage in the transfer roller 31. The generated voltage is measured by the voltmeter 78 when the transfer bias application power supply 81 applies a constant transfer current (−10 μA in FIG. 3) as the measurement current.

As shown in FIG. 3, for example, when using a thin sheet having a width of 190–161 mm, the process speed of the motor 79 is set to 25 ppm when the generated voltage of the transfer roller 31 measured by the voltmeter 78 is between −5 kV and −3 kV. The "standard" entry in FIG. 3 denotes a standard process speed, which is the maximum process speed of 28 ppm in the present embodiment.

Figure 4:
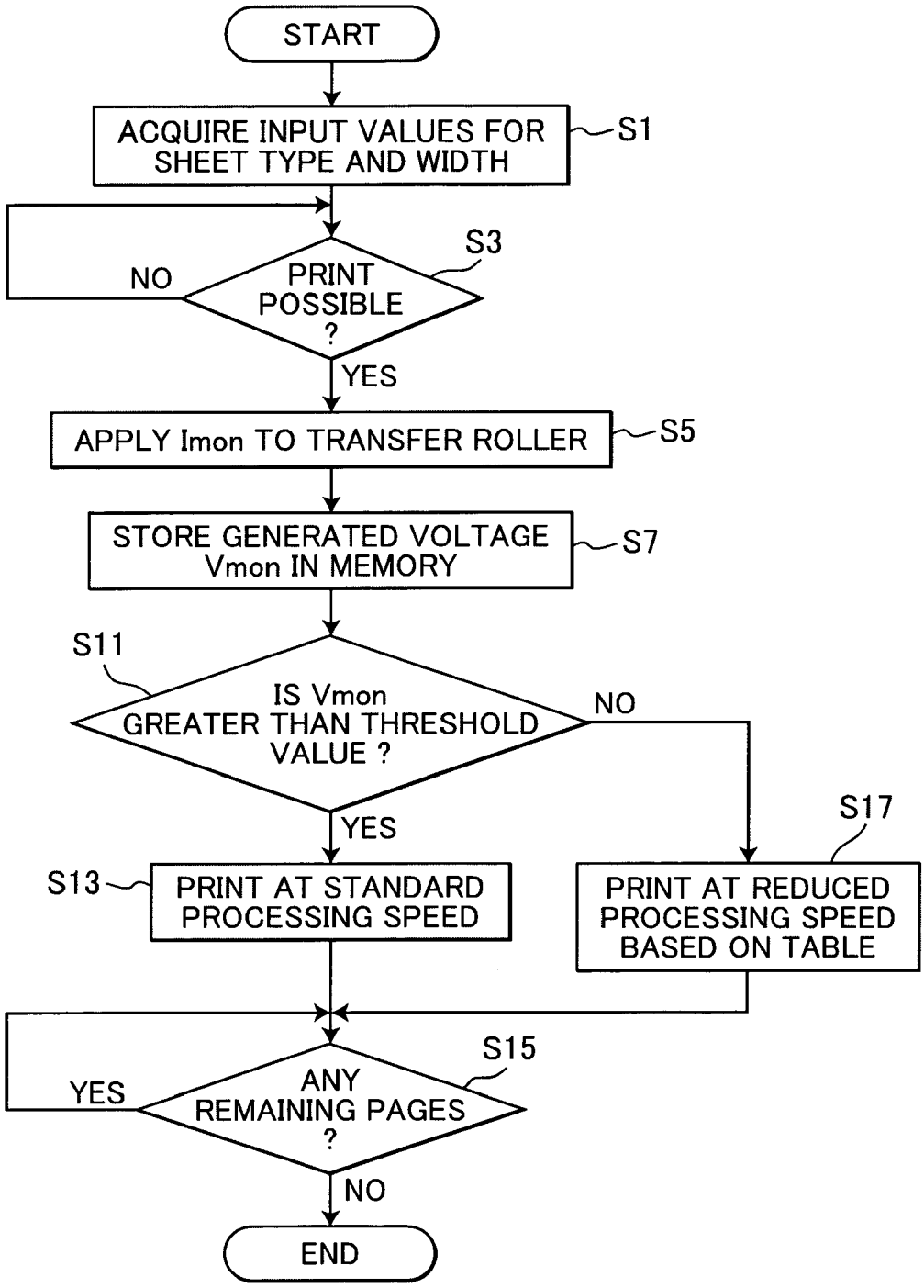
FIG. 4 is a flowchart representing a printing process performed by the laser printer of FIG. 1.

Next, a printing process executed by the CPU 71 using the process speed settings table will be described with reference to the flowchart in FIG. 4. The printing process starts when print data is inputted from the personal computer after a main power of the laser printer 1 is turned ON.

Once the printing process starts, first in S1, the CPU 71 acquires detected or input values for sheet type and sheet width from the sheet size sensor 74, the PC side printer property 75, or the operation panel 76, as described above. In S3, the CPU 71 performs various checks to ensure the sheet 3 is loaded, the cover is closed, and the like in order to determine whether the laser printer 1 is in a condition to perform the printing operation.

If the laser printer 1 is not in a condition to perform the printing operation (S3:NO), then the CPU 71 waits until the laser printer 1 becomes print capable. When the laser printer 1 is in a condition to perform the printing operation (S3: YES), then in S5, the CPU 71 begins supplying a predetermined electric current Imon (−10 μA in the present embodiment) to the transfer roller 31 prior to conveying the sheet 3. In S7, the voltmeter 78 measures a voltage Vmon generated at that time and stores this measured value in the RAM 73.

In S11, the CPU 71 determines whether the absolute value of the generated voltage Vmon exceeds a threshold value. Here, the threshold value indicates a value that determines whether the process speed set in the process speed settings table of FIG. 3 is "standard." When using thin sheet, for example, the threshold is 3 kV at a sheet width of 216–191 mm, 5 kV at a sheet width of 190–131 mm, and 7 kV at a sheet width of 130–70 mm.

If the generated voltage Vmon exceeds the threshold value (S11:YES), then in S13, the printing operation is performed at the standard process speed. In S15, the CPU 71 determines whether the print data includes another page of image data. If another page of image data remains (S15: YES) then the CPU 71 waits at S15 while the printing operation continues at the standard process speed. After completing the printing operation for all print data, that is, when no additional pages of image data exist (S15:NO), the process ends. When ending this process, the transfer bias is also turned OFF.

On the other hand, when the generated voltage Vmon is less than or equal to the threshold value (S11:NO), then in S17, the CPU 71 performs the printing operation at a decreased process speed according to the process speed settings table. For example, when printing on a thin sheet having a width of 200 mm, the printing operation is performed at 20 ppm if the generated voltage Vmon was −2 kV. Next, the CPU 71 advances to S15 and continues the printing operation as described above. When the printing operation is completed for all print data (S15:NO), the process ends. It should be noted that the transfer bias is set to −14 μA regardless of whether the process passes through S13 or S17.

In this way, the transfer roller 31 is controlled to reduce the transport speed of the sheet 3 when current leakage is more likely to occur due to either a narrow sheet width or low resistance of the transfer roller 31. Accordingly, the electric charge per unit area applied to the sheet 3 can be maintained constant even when the transfer bias is constant, enabling the visible image formed by toner on the photosensitive drum 28 to be properly transferred onto the sheet 3.

Hence a visible image can be satisfactorily transferred onto the sheet 3, even when the magnitude of the transfer bias cannot be sufficiently increased, while maintaining the magnitude of the transfer bias equal to or less than a prescribed value. Moreover, since the transport speed, which is determined by the process speed of the motor 79, is set based on the width and type of the sheet 3, it is possible to apply just enough electric charge to the sheet 3 based on a required charge amount which is determined according to current leakage occurring around the sheet 3 and the type of the sheet 3, such as the thickness and the like. As a result, a very satisfactory image can be formed on the sheet 3.

The electrical properties of a contact-type transfer member, such as the transfer roller 31 of the present embodiment, are easily affected by the temperature and humidity in the external air. Changes in these electrical properties in turn affect the electric charge supplied to the sheet 3. However, in the present embodiment, the electrical properties of the transfer roller 31 are measured as the generated voltage Vmon prior to performing a transfer operation and the transport speed is determined according to these measured electrical properties, as well as to the width and type of the sheet 3. Accordingly, the present invention can form a very satisfactory image on the sheet 3 without supplying an excess electric charge thereto.

Measuring the electrical properties of the transfer roller 31, which is a contact-type transfer member, according to the voltage generated when supplying a specific electric current to the transfer roller 31 in a manner described above is useful in maintaining the transfer bias at a constant current. By maintaining the transfer bias at a constant current, the effects of a humid environment on image formation can be further reduced.

Next, a modification of the present embodiment will be described with reference to FIGS. 5 and 6. In this modification, the electric current value of the transfer bias is controlled in a manner described below while maintaining the electric current value equal to or below a withstand current of the photosensitive drum 28 and the like, so that a better transfer is achieved based on sheet width, sheet type, and generated voltage Vmon. FIG. 5 shows a process speed settings table according to the present modification.

In this modification, when the absolute value of the generated voltage Vmon is less than or equal to the above described threshold value, the process speeds are set as in the above-described embodiment, and the transfer bias is set to −14 μA, which is sufficiently below the aforementioned withstand current. However, when the absolute value of the generated voltage Vmon is above the threshold value, then the process speed is set to the standard value of 28 ppm, and the transfer bias is set to the electric current values shown in the process speed settings table of FIG. 5.

More specifically, the magnitude of the transfer bias can be raised until the transfer bias reaches a predetermined value of −14 μA as the absolute value of the generated voltage decreases or the width of the sheet decreases, while the transport speed is maintained at a predetermined rate. In this way, a satisfactory image can be formed while maintaining the transport speed at a predetermined rate. If the transfer bias reaches −14 μA, the bias is fixed to −14 μA and the process speed is set slower instead of raising the transfer bias further. Hence, a satisfactory image can be formed on the sheet by adjusting the transport speed. By setting the transfer bias based on the electrical properties of the transfer roller 31 in this way, the electric charge to be supplied to the sheet 3 can be more satisfactorily adjusted than when adjusting only the transport speed.

Figure 6:
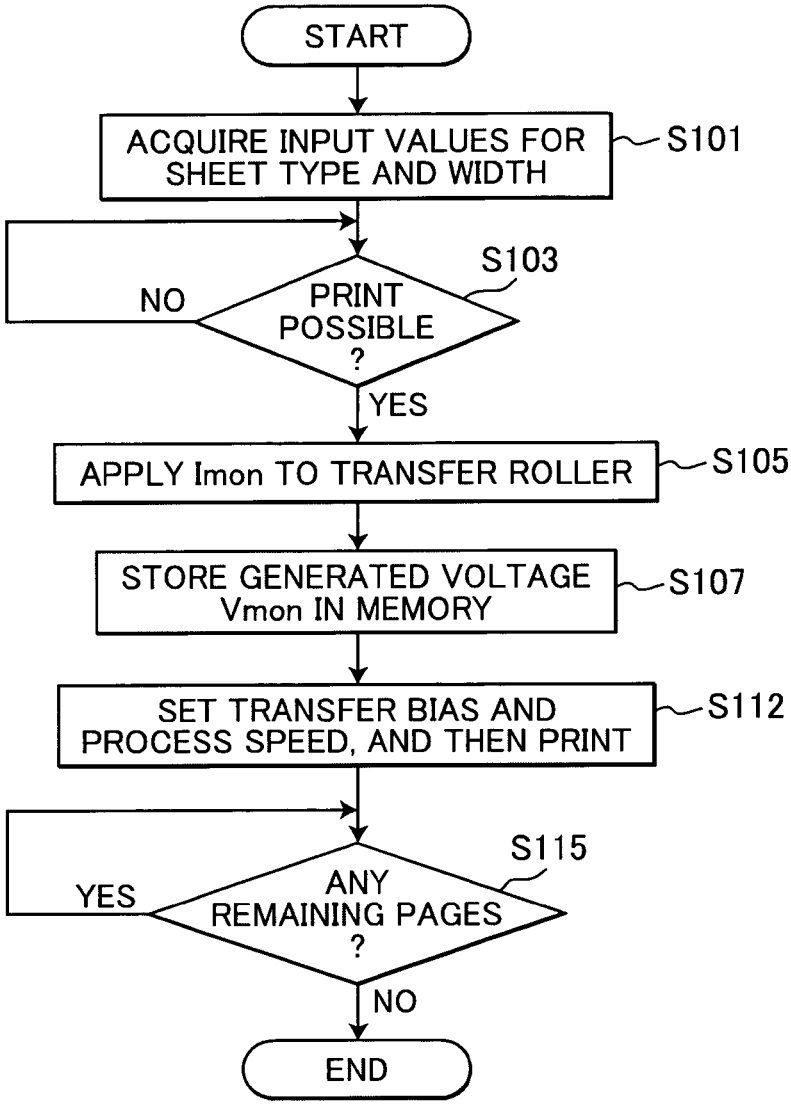
FIG. 6 is a flowchart representing a printing process according to the modification of the embodiment.

This control can be easily implemented by setting the transfer bias and process speed according to the process speed settings table in FIG. 5 in a manner shown in the flowchart of FIG. 6. Specifically, the processes in S101 to S107 are the same as those in S1 to S7 of FIG. 4. After S107, the CPU 71 determines the transfer bias and the process speed according to the process speed settings table in FIG. 5 and performs the printing operation in the determined bias and process speed. Then, the process proceeds to S115, in which the same process as in S15 of FIG. 4 is performed.

This control prevents an excess of toner from being transferred onto the sheet 3 when the sheet is wide and the absolute value of the generated voltage is large, thereby forming a more satisfactory image.

The same effects as those in the above-described modification can be obtained by setting the predetermined value of −10 μA rather than −14 μA and further reducing the process speed. However, the method in the above modification is preferable since a satisfactory image can be formed while maintaining operability of the image forming device by avoiding adjustments of the process speed as much as possible.

According to the above-described embodiment, the generated voltage Vmon is measured using the transfer bias application power supply 81 to apply the constant transfer current (−10 μA) to the transfer roller 31 as the measurement current. This process eliminates the need to prepare a process speed settings table for each measurement current, thereby simplifying the control process. Further, the CPU 71 in the laser printer 1 actuates the transfer bias application power supply 81 to apply the measurement current to the transfer roller 31 while the voltmeter 78 measures the voltage generated at that time, and the generated voltage is used as an index for the resistance value of the transfer roller 31. Accordingly, measurements can be performed using a simple construction.

It should be noted that the type of sheets in the present invention refers to at least one of material, form (cut sheet, roll sheet, envelopes, and other forms), and thickness. Properties in the present invention refers to at least one of material, form, thickness, and width.

While some exemplary embodiments of this invention have been described in detail, those skilled in the art will recognize that there are many possible modifications and variations which may be made in these exemplary embodiments while yet retaining many of the novel features and advantages of the invention.

For example, the generated voltage Vmon is measured at the beginning of the control process in the above embodiment. However, when continuously printing a plurality of sheets 3, the CPU 71 may return to S5 (S105) to re-measure the generated voltage after a prescribed number of pages are printed, such as every 100 pages. In this case, the generated voltage Vmon, which is an index for the resistance of the transfer roller 31, can be measured each time a prescribed number of sheets has been printed, enabling the process speed to be set to the optimum value based on the measured generated voltage Vmon, even when the resistance of the transfer roller 31 changes over time during a printing operation. Therefore, satisfactory transfers can be achieved during a continuous printing operation.

In the embodiment described above, the constant transfer current is applied as the measurement current, and the voltage generated at that time is referenced in order to determine the process speed and the transfer bias. However, it is also possible to apply a constant transfer voltage and reference the electric current generated at that time, or to reference the impedance of the transfer roller 31.

Referencing a generated electric current is useful when maintaining the transfer bias at a constant voltage. When the transfer bias is maintained at a constant voltage, the effects of the width of the sheet 3 on the image formation can be further reduced. Referencing impedance, on the other hand, is useful when maintaining the transfer bias at a constant current or at a constant voltage (for example, when performing constant power control or constant charge control). This method further facilitates the application of constant power control and constant charge control of the transfer bias.

Further, an electron conductive type transfer roller may be used as the transfer roller 31, or a transfer belt or the like may be used in place of the transfer roller 31. The embodiment described above covers a case of using a contact-type transfer member for transferring an image to the sheet 3 while the sheet 3 is conveyed through the operations of the transfer roller 31 itself. A noncontact-type transfer member, such as a transfer charger employing a charging wire, may also be used, but the effects of the width and type of the sheet 3 on the transfer operation are larger when using a contact-type transfer roller 31 that directly contacts the photosensitive drum 28. Therefore, the effects of the present invention are more striking in this case.

What is claimed is:

1. An image forming device comprising:

an image carrying member that carries a developer image;

a transfer member that transfers the developer image from the image carrying member onto a recording medium;

a bias applying member that applies a transfer bias to the transfer member;

a transport member that transports the recording medium;

an input member through which a width and a type of the recording medium are input;

a measuring member that measures electrical property of the transfer member; and a transport speed setting member that sets a transport speed at which the transport member transports the recording medium based on the width and the type of the recording medium inputted through the input member, and the electrical property measured by the measuring member.

2. The image forming device according to claim 1, wherein the transfer member is a contact-type transfer member that transfers the developer image to the recording medium while transporting the recording medium through its own operation, the transfer member serving as the transport member.

3. The image forming device according to claim 1, wherein the measuring member measures the electrical property of the transfer member before the transfer member performs the transfer.

4. The image forming device according to claim 3, wherein the electrical property is a voltage generated in the transfer member when a specific electric current is applied to the transfer member.

5. The image forming device according to claim 3, wherein the electrical property is an electric current generated in the transfer member when a predetermined voltage is applied to the transfer member.

6. The image forming device according to claim 3, wherein the electrical property is an impedance of the transfer member.

7. The image forming device according to claim 3, further comprising a transfer bias setting member that sets the transfer bias to be applied to the transfer member based on the electrical property measured by the measuring member.

8. The image forming device according to claim 7, wherein the electrical property is a voltage generated in the transfer member when a predetermined electric current is applied to the transfer member, and the transfer bias setting member sets one of electric current value and voltage value of the transfer bias based on the generated voltage.

9. The image forming device according to claim 7, wherein the electrical property is an electric current generated in the transfer member when a predetermined voltage is applied to the transfer member, and the transfer bias setting member sets one of electric current value and voltage value of the transfer bias based on the generated electric current.

10. The image forming device according to claim 7, wherein the electrical property is an impedance of the transfer member, and the transfer bias setting member sets one of electric current value and voltage value of the transfer bias based on the impedance of the transfer member.

11. The image forming device according to claim 7, wherein the bias applying member applies the transfer bias, which is set by the transfer bias setting member, to the transfer member if the transfer bias is equal to or less than a predetermined value when the transport speed is fixed to a predetermined speed, and the transfer member transports the recording medium at a speed slower than the predetermined speed and the bias applying member applies the transfer bias having the predetermined value if the transfer bias set by the transfer bias setting member exceeds the predetermined value when the transport speed is fixed to the predetermined speed.

12. The image forming device according to claim 7, wherein the transfer bias setting member sets the transfer bias larger when the electrical property requires a larger transfer bias and the bias applying member applies the transfer bias set by the transfer bias setting member to the transfer member while the transfer member transports the recording medium at a predetermined transport speed, provided that the magnitude of the transfer bias set by the transfer bias setting member is not greater than a predetermined value when the transport speed is maintained at the predetermined transport speed; and the bias applying member applies the transfer bias having the predetermined value to the transfer member, the transport speed setting member sets the transport speed to a speed slower than the predetermined transport speed, and the transfer member transports the recording medium at the transport speed set by the transport speed setting member, provided that the electrical property requires a transfer bias that exceeds the predetermined value when the transport speed is maintained at the predetermined speed.

13. The image forming device according to claim 1, wherein the type of the recording medium is a thickness of the recording medium.

14. An image forming device comprising:

an image carrying member that carries a developer image;

a transfer member that transfers the developer image from the image carrying member onto a recording medium, the transfer member being a contact-type transfer member that transfers the developer image while transporting the recording medium through its own operation;

a bias applying member that applies a transfer bias to the transfer member;

an input member through which characteristics of the recording medium are input;

a measuring member that measures electrical property of the transfer member before the transfer member performs the transfer; and a transport speed setting member that sets a transport speed at which the transfer member transports the recording medium based on the properties of the recording medium inputted through the input member and on the electrical property of the transfer member measured by the measuring member.

15. The image forming device according to claim 14, wherein the electrical property is a voltage generated in the transfer member when a specific electric current is applied to the transfer member.

16. The image forming device according to claim 14, wherein the electrical property is an electric current generated in the transfer member when a predetermined voltage is applied to the transfer member.

17. The image forming device according to claim 14, wherein the electrical property is an impedance of the transfer member.

18. The image forming device according to claim 14, further comprising a transfer bias setting member that sets the transfer bias to be applied to the transfer member based on the electrical property measured by the measuring member.

19. The image forming device according to claim 18, wherein the electrical property is a voltage generated in the transfer member when a predetermined electric current is applied to the transfer member, and the transfer bias setting member sets one of electric current value and voltage value of the transfer bias based on the generated voltage.

20. The image forming device according to claim 18, wherein the electrical property is an electric current generated in the transfer member when a predetermined voltage is applied to the transfer member, and the transfer bias setting member sets one of electric current value and voltage value of the transfer bias based on the generated electric current.

21. The image forming device according to claim 18, wherein the electrical property is an impedance of the transfer member, and the transfer bias setting member sets one of electric current value and voltage value of the transfer bias based on the impedance of the transfer member.

22. The image forming device according to claim 18, wherein the bias applying member applies the transfer bias, which is set by the transfer bias setting member, to the transfer member if the transfer bias is equal to or less than a predetermined value when the transport speed is fixed to a predetermined speed, and the transfer member transports the recording medium at a speed slower than the predetermined speed and the bias applying member applies the transfer bias having the predetermined value if the transfer bias set by the transfer bias setting member exceeds the predetermined value when the transport speed is fixed to the predetermined speed.

23. The image forming device according to claim 18, wherein the transfer bias setting member sets the transfer bias larger when the electrical property requires a larger transfer bias and the bias applying member applies the transfer bias set by the transfer bias setting member to the transfer member while the transfer member transports the recording medium at a predetermined transport speed, provided that the magnitude of the transfer bias set by the transfer bias setting member is not greater than a predetermined value when the transport speed is maintained at the predetermined transport speed; and the bias applying member applies the transfer bias having the predetermined value to the transfer member, the transport speed setting member sets the transport speed to speed slower than the predetermined transport speed, and the transfer member transports the recording medium at the transport speed set by the transport speed setting member, provide that the electrical property requires a transfer bias that exceeds the predetermined value when the transport speed is maintained at the predetermined speed.

* * * * *